US006280923B1

(12) United States Patent
Uytterhoeven et al.

(10) Patent No.: US 6,280,923 B1
(45) Date of Patent: Aug. 28, 2001

(54) PHOTOTHERMOGRAPHIC RECORDING MATERIAL

(75) Inventors: Herman Uytterhoeven, Bonheiden; Yvan Gilliams, Hever; Johan Loccufier, Zwijnaarde; Sabine Emmers, Lommel, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/009,717

(22) Filed: Jan. 20, 1998

Related U.S. Application Data

(63) Continuation of application No. PCT/EP96/02583, filed on Jun. 13, 1996.

(30) Foreign Application Priority Data

Jul. 18, 1995 (EP) ..... 95201968

(51) Int. Cl.[7] ..... G03C 1/498

(52) U.S. Cl. ..... 430/619; 430/617; 430/620; 430/531; 430/536

(58) Field of Search ..... 430/617, 619, 430/620, 531, 536, 203

(56) References Cited

U.S. PATENT DOCUMENTS

| | | | | |
|---|---|---|---|---|
| 3,080,254 | | 3/1963 | Grant . | |
| 3,152,904 | | 10/1964 | Sorensen et al. . | |
| 3,457,075 | | 7/1969 | Morgan et al. . | |
| 3,839,049 | | 10/1974 | Simons . | |
| 4,102,312 | | 7/1978 | Sashihara et al. | 96/114.1 |
| 4,123,274 | * | 10/1978 | Knight et al. . | |
| 4,144,072 | | 3/1979 | Ikenoue et al. . | |
| 4,504,575 | * | 3/1985 | Lee | 430/531 |
| 4,529,689 | | 7/1985 | Lee . | |
| 5,447,832 | * | 9/1995 | Wang et al. | 430/523 |

FOREIGN PATENT DOCUMENTS

| | | |
|---|---|---|
| 2819855 | 11/1978 | (DE) . |
| 0599463 | 1/1994 | (EP) . |
| 2119945 | 11/1983 | (GB) . |
| 62139550 | 6/1987 | (JP) . |

OTHER PUBLICATIONS

Research Diclosure Jul. 1980, pp. 301309.*

Research Disclosure, No. 170, Jun. 1978, pp. 9–15, XP002020220; Carpenter et al.; "Photothermographic Silver Halide Systems"; See p. 11, left–hand column, line 5–line 6.

* cited by examiner

*Primary Examiner*—Thorl Chea
(74) *Attorney, Agent, or Firm*—Baker Botts L.L.P.

(57) ABSTRACT

A photothermographic recording material comprising a support and a photo-addressable thermally developable element comprising photosensitive silver halide in catalytic association with a substantially light-insensitive silver salt of an organic carboxylic acid, an organic reducing agent for the substantially light-insensitive silver salt of an organic carboxylic acid in thermal working relationship therewith and a binder, characterized in that the binder is water soluble or water dispersible and the reducing agent is a non-sulfo-substituted 6-membered aromatic or heteroaromatic ring compound with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annelated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substiuent is an amino-group and the photo-addressable thermally developable element is coated from an aqueous medium and is capable of producing stable images without a wet-processing step. A process for producing the photothermographic recording material and a photothermographic recording process therefor is also provided.

22 Claims, 1 Drawing Sheet

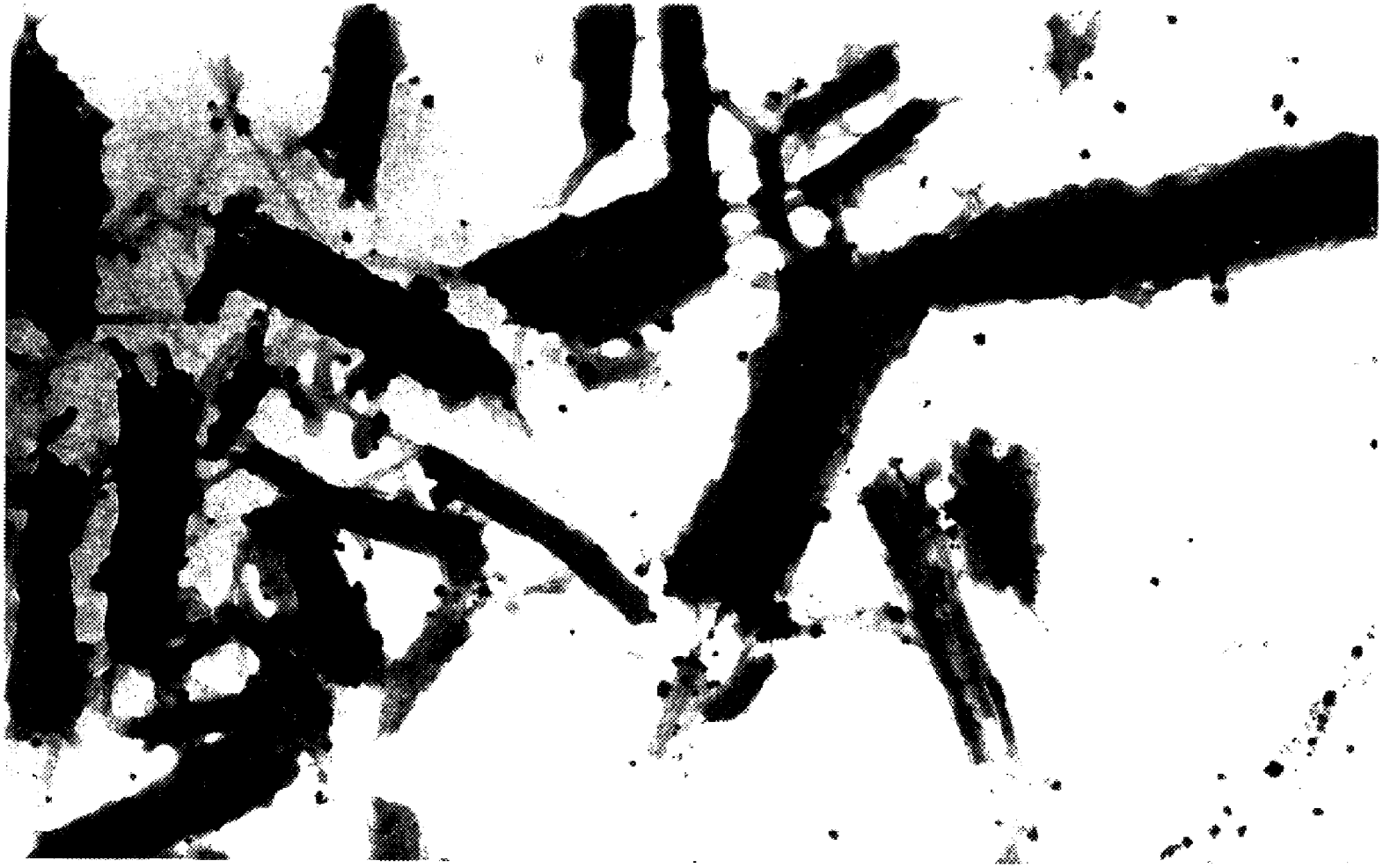

PHOTOTHERMOGRAPHIC RECORDING MATERIAL

This is a continuation of International Application PCT/EP96/02583, with an international filing date of Jun. 13, 1996.

DESCRIPTION

1. Field of the Invention

The present invention relates to a photothermographic recording material comprising a photo-addressable thermally developable element coatable from aqueous media.

2. Background of the Invention

Thermal imaging or thermography is a recording process wherein images are generated by the use of thermal energy.

In thermography three approaches are known:

1. Direct thermal formation of a visible image pattern by imagewise heating of a recording material containing matter that by chemical or physical process changes colour or optical density.

2. Imagewise transfer of an ingredient necessary for the chemical or physical process bringing about changes in colour or optical density to a receptor element containing other of the ingredients necessary for the chemical or physical process followed by uniform heating to bring about the changes in colour or optical density.

3. Thermal dye transfer printing wherein a visible image pattern is formed by transfer of a coloured species from an imagewise heated donor element onto a receptor element.

Thermographic materials of type 1 can be rendered photothermographic by incorporating a photosensitive agent which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over the sheet, and as the image forming component an oxidation-reduction reaction combination which is substantially latent under ambient conditions and which can be initiated into reaction by the free metal to produce a visible change in colour comprising an organic silver salt containing carbon atoms and different from the heavy metal salt as an oxidizing agent and in addition an organic reducing agent containing carbon atoms, the radiation-sensitive heavy metal salt being present in an amount between about 50 and about 1000 parts per million of the oxidation-reduction reaction combination. As solid reducing agents to be used in the material disclosed in U.S. Pat. No. 3,152,904 are cited: relatively light stable organic compounds such as the substituted pyrazolidones, the substituted and non-substituted hydroxylamines e.g. phenyl hydroxylamine and benzyl hydroxylamine, aminophenols e.g. N-methyl paraminophenol sulfate, the dihydric phenols e.g. hydroquinone and catechol, aromatic esters e.g. methyl gallate, and aromatic diamines e.g. phenylene diamine.

The detailed description of U.S. Pat. No. 4,144,072 discloses the following representative selection of preferred reducing agents for use with photothermographic materials based on silver halide/organic silver salt/reducing agent-systems: mono-, bis-, tris- or tetrakis-phenols, mono- or bis-naphthols, di- or polyhydroxynaphthalenes, di- or polyhydroxybenzenes, hydroxymonoethers, ascorbic acids, 3-pyrazolines, pyrazolones, reducing saccharides, phenylenediamines, hydroxylamines, reductones, hydroxamic acids, hydrazides, amidoximes, n-hydroxyureas, and the like; polyphenols such as the bisphenols used in the 3M Dry Silver™ materials, sulfonamide phenols such as used in the Kodak Dacomatic™ materials, and naphthols being particularly preferred.

The standard teaching over such photothermographic materials based on a substantially light-insensitive organic silver salt, photosensitive silver halide in intimate catalytic association with the organic silver salt and a reducing agent for the organic silver salt is that the organic silver salt is formed, optionally in the presence of ex situ formed silver halide, in an aqueous medium and is precipitated and dried before dispersion in an organic solvent medium from which the dispersion is coated, the silver halide either being prepared ex situ, and either added to a dispersion of the organic silver salt as described in U.S. Pat. No. 3,080,254 or being present during the formation of the organic silver salt as disclosed in U.S. Pat. No. 3,839,049, or being prepared in situ from the organic silver salt by reaction with a halide ion source as disclosed in U.S. Pat. No. 3,457,075. In the latter case reaction of organic silver salt with a halide ion source, which can be inorganic or organic, occurs after the dispersion of the organic silver salt in a solvent medium and hence the reaction takes place in a non-aqueous medium.

This production method is very inefficient as the organic silver salt after formation in water has to be separated and dried before dispersion in a solvent medium, is environmentally unsound as evaporation of solvent takes place during the coating process and it involves lengthy utilization of plant during the preparation of the organic silver salt dispersion and coating requires costly plant due to the need for solvent explosion prevention measures and solvent recovery to prevent solvent emission to the environment.

Furthermore, it is desirable spectrally to sensitize photosensitive silver halide in water-containing media as this permits the use of a broader range of spectrally sensitizing dyes.

The invention of U.S. Pat. No. 4,123,274 attempts to remedy this deficiency by disclosing a photothermographic element coatable from aqueous media comprising a support having thereon in reactive association (a) photosensitive silver halide, (b) an image-forming combination comprising (i) a silver salt of a 3-amino-1,2,4-mercaptotriazole represented by the formula:

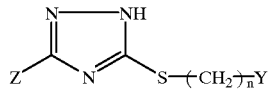

where Y is aryl containing 6 to 12 carbon atoms; n is 0 to 2; and Z is hydrogen, hydroxyl or —$NH_2$; with (ii) a silver halide developing agent, and a polymeric binder. According to the description of U.S. Pat. No. 4,123,274, "the described photothermographic materials can contain a variety of silver halide developing agents, especially organic silver halide developing agents. Combinations of organic silver halide developing agents can be especially useful. For example, a combination of a pyrazolidone developing agent with an ascorbic acid developing agent can be useful. However, a variety of silver halide developing agents are useful including, for instance, polyhydroxy-benzenes, such as hydroquinone, alkyl-substituted hydroquinones, including tertiary butylhydroquinone, methylhydroquinone, 2,5-dimethylhydroquinone, and 2,6-dimethylhydroquinone; catechol and pyrogallol developing agents; chloro-substituted hydroquinones such as chlorohydroquinone of dichlorohydroquinone; alkoxyhydroquinones such as methoxyhydroquinone or ethoxyhydroquinone; aminophenol reducing agents such as 2,4-diaminophenols and methylaminophenols; ascorbic developing agents such as ascorbic acid, ascorbic acid ketals and ascorbic acid derivatives; 3-pyrazolidone developing agents such as 1-phenyl-3-pyrazolidone and 4-methyl-4-hydroxymethyl-1-phenyl-3-pyrazolidone; reductone silver halide developing agents such as 2-hydroxy-5-methyl-3-piperidino-2-cyclopentanone; gallic acid ester reducing agents such as methylgallate; sulfonamidophenol developing agents such as the sulfonylamidophenol developing agents described in Research Disclosure, January 1973, pages 16–21; phenylenediamine developing agents such as paraphenylenediamine and the like. Especially useful developing agents are those which are hydroquinone, ascorbic acid, pyrogallol, gallic acid ester and phenylenediamine silver halide developing agents and combinations of these developing agents." The following reducing agents were used in the invention examples of U.S. Pat. No. 4,123,274: hydroquinone, tertiary butylhydroquinone and ascorbic acid. The photothermographic recording materials of U.S. Pat. No. 4,123,274 have the disadvantages of requiring thermal development temperatures: 145 to 200° C. for 30s and producing images with a red-brown tone, which is prohibitive for medical or graphics images, whereas silver behenate-based materials require considerably lower development temperatures, 90 to 120° C. for 5 to 20s, and produce images with a blacker tone.

The invention of U.S. Pat. No. 4,529,689 attempts to remedy this deficiency by disclosing a photothermographic film composition comprising (a) a substantially light-insensitive silver sulfinate, (b) a photographic silver halide emulsion, (c) a developing (reducing) agent, and (d) a binder; characterized in that the silver sulfinate is selected from the group consisting of silver hexadecylsulfinate, silver dodecylsulfinate, silver nonylsulfinate, silver 3-phenylpropylsulfinate, and silver cyclohexylsulfinate, and wherein the binder is a latex. The reducing agents used in the invention examples of this patent were 4-methyl-1-phenylpyrazolidin-3-one and 4-hydroxymethyl-4-methyl-1-phenyl-pyrazolidin-3-one with 4,4-dimethyl-1-phenyl-pyrazolidin-3-one, 1-phenylpyrazolidin-3-one, hydroquinone, hydroquinone monosulfonate, ascorbic acid, p-aminophenol sulfate, dodecyl gallate and N-benzyl-p-aminophenol being additionally mentioned in the detailed description of this patent. Furthermore, in all the examples according to the invention disclosed in U.S. Pat. No. 4,529,689, it is necessary after exposure and thermal development of the photothermographic film composition to fix it for 1 minute with ammonium thiosulfate followed by washing in running water and drying to avoid print up (darkening) of the unexposed areas of the image. This necessity for the wet fixing of the photothermographic film compositions disclosed in the invention examples of U.S. Pat. No. 4,529,689 removes the essential advantage of so-called "Dry Silver" photothermographic materials over classical silver halide emulsion materials namely the avoidance of wet processing.

U.S. Pat. No. 4,504,575 discloses a photothermographic film comprising a silver salt as physical developer, a silver halide as photocatalyst, and a binder, wherein the improvement comprises using a light-insensitive silver sulfonate as the physical developer in combination with an organic base and wherein the silver sulfonate is silver dodecylsulfonate or silver hexadecylsulfonate. The reducing agents used in the invention examples of this patent were hydroquinone monosulfonate and hydroquinone with no further reducing agents being mentioned in the detailed description of this patent. However, swabbing with a 5% ethanolic solution of phenyl mercaptotetrazole or a 5% ethanolic solution of p-toluenesulfonic acid is necessary, according to the invention examples, to prevent print-up, thereby removing the essential advantage of so-called "Dry Silver" photothermographic materials over classical silver halide emulsion materials, namely the avoidance of wet processing.

Thus, despite forty years of continuous research in this area, a production method for photothermographic materials based on a substantially light-insensitive organic silver salt, photosensitive silver halide in intimate catalytic association with the organic silver salt and a reducing agent for the organic silver salt which dispenses with these disadvantages of the current teaching, has to our knowledge not yet been developed.

OBJECTS OF THE INVENTION

It is a first object of the invention to provide a photothermographic recording material comprising a photo-addressable thermally developable element with excellent image-forming properties.

It is a second object of the invention to provide a photothermographic recording material comprising a photo-addressable thermally developable element based on a substantially light-insensitive silver salt of an organic carboxylic acid, photosensitive silver halide in catalytic association therewith and an organic reducing agent for the silver salt of an organic carboxylic acid, which is produceable without necessitating intermediate drying of the silver salt of an organic carboxylic acid acid.

It is another object of the invention to provide a photothermographic recording material comprising a photo-addressable thermally developable element based on a substantially light-insensitive silver salt of an organic carboxylic acid, photosensitive silver halide in catalytic association therewith and an organic reducing agent for the silver salt of an organic carboxylic acid, which is coatable from an aqueous medium.

It is a further object of the invention to provide a photothermographic recording material with reduced print up after image formation without a wet processing step.

It is a still further object of the invention to provide a photothermographic recording material not requiring a wet processing step in order to obtain a stable image.

It is a yet a still further object of the invention to provide a recording process for a photothermographic recording material with the above improved characteristics.

Further objects and advantages of the invention will become apparent from the description hereinafter.

SUMMARY OF THE INVENTION

According to the present invention a photothermographic recording material is provided comprising a support and a photo-addressable thermally developable element comprising photosensitive silver halide in catalytic association with a substantially light-insensitive silver salt of an organic carboxylic acid, an organic reducing agent for the substantially light-insensitive silver salt of an organic carboxylic acid in thermal working relationship therewith and a binder, characterized in that the binder is water soluble or water dispersible and the reducing agent is a non-sulfo-substituted 6-membered aromatic or heteroaromatic ring compound with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annulated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substiuent is an amino-group. The photo-addressable thermally developable element is coated from an aqueous medium and is capable of producing stable images without a wet-processing step.

A process is also provided for producing a photothermographic recording material, as referred to above, comprising the steps of: (i) producing a suspension of particles of a substantially light-insensitive silver salt of an organic carboxylic acid; (ii) producing an aqueous dispersion or aqueous dispersions containing ingredients necessary for photothermographic image formation; (iii) coating the aqueous dispersion or aqueous dispersions onto a support.

A photothermographic recording process is further provided comprising the steps of: (i) image-wise exposing a photothermographic recording material, as referred to above, to a source of actinic radiation to which the photothermographic recording material is sensitive; and (ii) thermally developing said image-wise exposed photothermographic recording material.

Preferred embodiments of the present invention are disclosed in the detailed description of the invention.

DETAILED DESCRIPTION OF THE INVENTION

The invention is described hereinafter by way of examples with reference to the accompanying figure wherein:

FIG. 1: shows a transmission electron micrograph at a magnification of 50,000× of the silver behenate/silver bromide dispersion produced in the course of the preparation of invention example 24.

Aqueous

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc; glycols e.g. ethylene glycol; glycerine; N-methyl pyrrolidone; methoxypropanol; and ketones e.g. 2-propanone and 2-butanone etc.

Organic Reducing Agent

According to the present invention, a photothermographic recording material is provided comprising a support and a photo-addressable thermally developable element comprising photosensitive silver halide in catalytic association with a substantially light-insensitive silver salt of an organic carboxylic acid, an organic reducing agent for the substantially light-insensitive silver salt of an organic carboxylic acid in thermal working relationship therewith and a binder, characterized in that the binder is water soluble or water dispersible and the reducing agent is a non-sulfo-substituted 6-membered aromatic or heteroaromatic ring compound with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annulated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substiuent is an amino-group. By "a system of conjugated double bonds" is meant a succession of alternating single and double bonds in the sense of the definition of conjugated double bonds given in the "Concise Chemical and Technical Dictionary, Fourth Edition", edited by H. Bennett and published by Edward Arnold in 1986: Two double bonds separated by a single bond".

The reducing agents of the present invention may also be used in the photothermographic recording materials of the present invention together with other reducing agents according to the present invention or with reducing agents outside the present invention.

In preferred embodiments, according to the present invention, the ring atoms of the non-sulfo-substituted 6-membered aromatic or heteroaromatic ring compound consist of nitrogen and carbon ring atoms and the non-sulfo-substituted 6-membered aromatic or heteroaromatic ring compound is annulated with an aromatic or heteroaromatic ring system.

In a further preferred embodiment the non-sulfo-substituted 6-membered aromatic or heteroaromatic ring compound is substituted with one or more of the following substituents which may also be substituted: alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl.

In other preferred embodiments, according to the present invention, the non-sulfo-substituted 6-membered aromatic or heteroaromatic ring compound is a substituted catechol or a substitued hydroquinone.

In a particularly preferred embodiment, according to the present invention, the non-sulfo-substituted 6-membered aromatic or heteroaromatic ring compound is selected from the group consisting of 3-(3',4'-dihydroxyphenyl)propionic acid, 3',4'-dihydroxy-butyrophenone, methyl gallate, ethyl gallate and 1,5-dihydroxy-naphthalene.

During the thermal development process the reducing agent must be present in such a way that it is able to diffuse to the substantially light-insensitive particles of a silver salt of an organic carboxylic acid so that reduction of the substantially light-insensitive silver salt of an organic carboxylic acid can take place. The reducing agent may be present in the same layer as the substantially light-insensitive silver salt of an organic carboxylic acid, in an adjacent layer or in a layer with a reducing agent-permeable spacer layer between the layer containing the reducing agent and that containing the silver salt of an organic carboxylic acid. The concentration of reducing agent is chosen to ensure optimum imaging properties, which is usually about one molar equivalent of reducing group (i.e. —OH, —NH or —SH) per mole of the silver salt of an organic carboxylic acid, but can be more or less.

Examples of suitable reducing agents according to the present invention are:

REDU 01: methyl gallate
also cited in the description of U.S. Pat. No. 3,152,904;

REDU 02: methylhydroquinone

REDU 03: t-butylhydroquinone

REDU 04: methoxyhydroquinone
also cited together with REDU 01 in the description of U.S. Pat. No. 4,1230274;

REDU 05: 3-(3',4'-dihydroxyphenyl)propionic acid

REDU 06: (3',4'-dihydroxyphenyl)acetic acid

REDU 07: 3,4-dihydroxybenzoic acid

REDU 08: methyl 3,4-dihydroxy-5-methoxybenzoate

REDU 09: methyl 3,4-dihydroxy-5-toluenesulfonylbenzoate

REDU 10: 3',4'-dihydroxy-butyrophenone

REDU 11: 3,5-di-t-butyl-catechol

REDU 12: 4-phenylcatechol

REDU 13: 2,5-dihydroxybenzoic acid

REDU 14: ethyl 2,5-dihydroxybenzoate

REDU 15: ethyl gallate

REDU 16: 1-methyl-3-oxy-pentyl gallate

REDU 17: 2,3-dihydroxypyridine

REDU 18: 3,3,3',3'-tetramethyl-1,1'-spirobisindane-5,5',6,6'-tetrol

REDU 19: 2:3-dihydroxynaphthalene

REDU 20: 1,5-dihydroxynaphthalene

REDU 21: 5-hydroxyanthranilic acid

REDU 22: 2-amino-5-dimethylaminosulfonyl-phenol

Auxiliary Reducing Agents

The above mentioned reducing agents, regarded as primary or main reducing agents, may be used in conjunction with so-called auxiliary reducing agents. Such auxiliary reducing agents are e.g. sterically hindered phenols, that on heating become reactive partners in the reduction of the substantially light-insensitive silver salt of an organic carboxylic acid such as silver behenate, such as described in U.S. Pat. No. 4,001,026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols corresponding to the following general formula

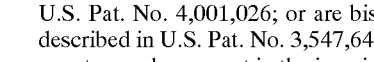

Aryl-$SO_2$—NH-Arylene-OH in which:

Aryl represents a monovalent aromatic group, and

Arylene represents a bivalent aromatic group, having the —OH group preferably in para-position to the —$SO_2$—NH— group.

Sulfonamidophenols according to the above defined general formula are described in Research Disclosure 17842 published in February 1979, U.S. Pat. No. 4,360,581, U.S. Pat. No. 4,782,004, and in EP-A 423 891, wherein these reducing agents are mentioned for use in a photothermographic material in which photosensitive silver halide is present in catalytic proximity to a substantially light-insensitive silver salt of an organic acid.

Other auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. No. 3,460,946 and 3,547,648.

Water-dispersible and Water-soluble Binders

According to the present invention the photo-addressable thermally developable element comprises a binder comprising a water-soluble binder, water-dispersible binder or a mixture of a water soluble binder and a water-dispersible binder. An important prerequisite in the choice of binders and binder mixtures is their ability to form a continuous layer with the other ingredients present.

In a preferred embodiment of the present invention the binder is a polymer latex.

In a particularly preferred embodiment the binder is a polymer comprising monomer units selected from the group consisting of a diene-monomer and a methacrylate.

In another particularly preferred embodiment the binder is a polymer comprising monomer units selected from the group consisting of styrene and an acrylate.

An important prerequisite in the choice of binders is their ability to form a continuous layer with the other ingredients present.

The water-dispersible binder can be any water-insoluble polymer e.g. water-insoluble cellulose derivatives, polymers derived from $\alpha,\beta$-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed under the trade name BUTVAR B79 of Monsanto USA and provides a good adhesion to paper and properly subbed polyester supports. It should be noted that there is no clear cut transition between a polymer dispersion and a polymer solution in the case of very small polymer particles resulting in the smallest particles of the polymer being dissolved and those slightly larger being in dispersion.

Suitable water-soluble polymers, according to the present invention, are: polyvinyl alcohol, polyacrylamide, polyacrylic acid, polymethacrylic acid, polyethyleneglycol, proteins, such as gelatin and modified gelatins such as phthaloyl gelatin, polysaccharides, such as starch, gum arabic and dextran and water-soluble cellulose derivatives.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

Photo-addressable Thermally Developable Element

The photo-addressable thermally developable element, according to the present invention, comprises a substantially light-insensitive silver salt of an organic carboxylic acid, photosensitive silver halide in catalytic association therewith and an organic reducing agent in thermal working relationship with the substantially light-insensitive silver salt of an organic carboxylic acid and a water soluble or water-dispersible binder. The element may comprise a layer system with the silver halide in catalytic association with the substantially light-insensitive silver salt of an organic carboxylic acid, spectral sensitizer optionally together with a supersensitizer in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive silver salt of an organic carboxylic acid i.e. during the thermal development process the reducing agent and the toning agent, if present, are able to diffuse to the substantially light-insensitive silver salt of an organic carboxylic acid.

Light-insensitive Silver Salts of Organic Carboxylic Acids

Preferred substantially light-insensitive silver salts of organic carboxylic acids produced using the process according to the present invention and used in the photothermographic materials, according to the present invention, are silver salts of organic carboxylic acids having as their organic group: aryl, aralkyl, alkaryl or alkyl. For example aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group, as described e.g. in GB-P 1,111,492, may likewise be used to produce a thermally developable silver image.

In a preferred embodiment, according to the present invention, the substantially light-insensitive silver salt of an organic carboxylic acid is a silver salt of a fatty acid.

The term substantially light-insensitive silver salt of an organic carboxylic acid for the purposes of the present invention also includes mixtures of silver salts of organic carboxylic acids.

Binder to Silver Salt of an Organic Carboxylic Acid Ratio

The binder to silver salt of an organic carboxylic acid weight ratio is preferably in the range of 0.2 to 6, and the thickness of the recording layer is preferably in the range of 1 to 50 $\mu$m.

Production of Particles of Silver Salt of an Organic Carboxylic Acid

Particles of the silver salts of organic carboxylic acids are prepared by the reaction of a soluble silver salt with the organic carboxylic acid or a salt thereof.

According to a process, according to the present invention, the suspension of particles of a substantially light-insensitive silver salt of an organic carboxylic acid is produced by simultaneous metered addition of an aqueous solution or suspension of an organic carboxylic acid, or its salt, and an aqueous solution of a silver salt to an aqueous liquid and the metered addition of the aqueous solution or suspension of the organic carboxylic acid or its salt; and/or the aqueous solution of said silver salt is regulated by the concentration of silver ions or the concentration of anions of the silver salt in the aqueous liquid.

This metered addition may be regulated by varying the rate of addition of the aqueous solution or suspension of the organic carboxylic acid or its salt; and/or the rate of addition of the aqueous solution of the silver salt so as to maintain the value of a physical parameter, that significantly changes upon the addition of the aqueous solution or suspension of the organic carboxylic acid or its salt and/or the aqueous solution of the silver salt to the aqueous liquid, at a particular value predetermined for a particular moment in the process. The value of the physical parameter used to regulate the addition of the aqueous solution or suspension of an organic carboxylic acid or its salt and/or the aqueous solution of the silver salt to the aqueous liquid may vary during the course of the production process.

Furthermore, the physical parameter used to regulate the metered addition of the aqueous solution or suspension of the organic carboxylic acid or its salt; and/or the aqueous solution of the silver salt, according to the present invention, may be the concentration of silver ions or the concentration of anions of the silver salt in the aqueous liquid. Other physical parameters that may be used to regulate the metered addition of the aqueous solutions are, for example, the electrical conductivity of the suspending medium, the dielectric constant of the suspending medium, the density of the suspending medium, the pH of the suspending medium etc.

The temperatures of the aqueous solution or suspension of the organic carboxylic acid or its salt; the aqueous solution of the silver salt; and the aqueous liquid are determined by the required characteristics of the particles; and may be kept constant or may be varied during the synthesis of the silver salt of a organic carboxylic acid again depending upon the required characteristics of the particles.

The aqueous liquid for suspending the particles may contain a non-ionic or anionic surfactant for said particles. Such surfactants may also be present in the aqueous solution or suspension of the organic carboxylic acid or its salt; and in the aqueous solution of the silver salt; may be added via an additional jet during the production process of the suspension of particles containing a substantially light-insensitive silver salt of a organic carboxylic acid; and may be added at the end of the production process.

A process for producing a photothermographic recording material according to the present invention, is also provided, wherein the process further comprises the step of producing particles of the photosensitive silver halide from excess silver ions associated with particles of the substantially light-insensitive silver salt of an organic carboxylic acid.

The regulated excess of silver ions during the production of the particles may be achieved by maintaining the UAg of the aqueous liquid, defined as the potential difference between a silver electrode (of ≧99.99% purity) in the liquid and a reference electrode consisting of a Ag/AgCl-electrode in 3M KCl solution at room temperature connected with the liquid via a salt bridge consisting of a 10% $KNO_3$ salt solution, at 70° C. at at least 380 mV.

During or after completion of the production of the suspension, salts produced during the process and any excess dissolved ions, for example silver ions, may be removed by on-line or off-line desalting processes such as dialysis or ultrafiltration. Desalting of the suspension may also be achieved after completion of the production process by precipitation of the suspension, followed by decantation, washing and redispersion.

Furthermore, the suspending medium may be changed from a hydrophilic to a hydrophobic suspending medium.

A process according to the present invention may be carried out batchwise or in continuous mode in any suitable recipient.

Photosensitive Silver Halide

The photosensitive silver halide used in the present invention may be employed in a range of 0.1 to 35 mol percent of substantially light-insensitive silver salt of an organic carboxylic acid, with the range of 0.5 to 20 mol percent being preferred and the range of 1 to 12 mol percent being particularly preferred.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Emulsion of Silver Salt of an Organic Carboxylic Acid and Photosensitive Silver Halide The silver halide may be added to the photo-addressable thermally developable element in any fashion which places it in catalytic proximity to the substantially light-insensitive silver salt of an organic carboxylic acid. Silver halide and the substantially light-insensitive silver salt of an organic carboxylic acid which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the silver salt of an organic carboxylic acid to partially convert the substantially light-insensitive silver salt of an organic carboxylic acid to silver halide as disclosed in U.S. Pat. No. 3,457,075.

According to a preferred embodiment according to the present invention, particles of the photosensitive silver halide are non-aggregating in the photo-addressable thermally developable element and are uniformly distributed over and between particles of the substantially light-insensitive silver salt of an organic carboxylic acid, at least 80% by number of the particles having a diameter, determined by transmission electron microscopy, of $\leqq 40$ nm.

According to another preferred embodiment according to the present invention, a production process for the photothermographic recording material is provided further comprising the step of forming particles of the photosensitive silver halide by reacting an aqueous emulsion of particles of the substantially light-insensitive silver salt of an organic carboxylic acid with at least one onium salt with halide or polyhalide anion(s).

According to a process, according to a still further preferred embodiment of the present invention, particles of the photosensitive silver halide are produced from excess silver ions associated with particles of the substantially light-insensitive silver salt of a organic carboxylic acid produced by simultaneous metered addition of an aqueous solution or suspension of a organic carboxylic acid, or its salt, and an aqueous solution of a silver salt to an aqueous liquid. Agents used for converting the excess dissolved silver ions into a silver salt may be inorganic halides, such as metallic halides e.g. KBr, KI, $CaBr_2$, $CaI_2$ etc.; or ammonium halides.

In a further embodiment, according to the present invention, production of the suspension of particles containing a substantially light-insensitive silver salt is immediately followed by the production of silver halide "in-situ" in the same recipient, thereby producing a photosensitive suspension.

The aqueous emulsion of the silver salt of an organic carboxylic acid optionally including photosensitive silver halide can, according to the present invention, also be produced from particles of the silver salt of an organic carboxylic acid optionally containing photosensitive silver halide by dispersing the particles in water in the presence of non-ionic or anionic surfactants or a mixture of non-ionic and anionic surfactants using any dispersion technique known to one skilled in the art such as ball milling, dispersion in a impingement mill (rotor-stator mixer), dispersion in a microfluidizer etc. A combination of dispersion techniques may also be used, for example using a first technique to produce a predispersion and a second technique to produce a fine dispersion.

Onium Halides and Polyhalides

According to the present invention photosensitive silver halide particles produced by reacting an aqueous dispersion of particles of the substantially light-insensitive silver salt of an organic carboxylic acid with at least one onium salt with halide or polyhalide anions may be present. The halide or polyhalide onium salts, according to the present invention, may be added as solids or solutions or may be formed in the aqueous dispersion of particles of the substantially light-insensitive silver salt by metathesis between a salt with halide or polyhalide anions and onium salts with anions other than halide or polyhalide.

Preferred oniums according to the present invention are organo-phosphonium, organo-sulphonium and organo-nitrogen onium cations, with heterocyclic nitrogen onium (e.g. pyridinium), quaternary phosphonium and ternary sulphonium cations being preferred. Preferred halide anions, according to the present invention, are chloride, bromide and iodide. Preferred polyhalide anions, according to the present invention, consist of chlorine, bromine and iodine atoms.

Onium cations, according to the present invention, may be polymeric or non-polymeric. Preferred non-polymeric onium salts for partial conversion of particles of substantially light-insensitive silver salt of an organic carboxylic acid into photo-sensitive silver halides according to the present invention are:

PC01=3-(triphenyl-phosphonium)propionic acid bromide perbromide

PC02=3-(triphenyl-phosphonium)propionic acid bromide

PC03=3-(triphenyl-phosphonium)propionic acid iodide

The onium salts, according to the present invention, are present in quantities of between 0.1 and 35 mol % with respect to the quantity of substantially light-insensitive silver salt of an organic carboxylic acid, with quantities between 0.5 and 20 mol % being preferred and quantities between 1 and 12 mol % being particularly preferred.

Spectral Sensitizer

According to a preferred embodiment of the present invention, the photo-addressable thermally developable element of the photothermographic recording material further comprises a dye with maximum absorbance in the wavelength range 600 to 1100 nm.

The photo-addressable thermally developable element of the photothermographic recording material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

Thermal Solvents

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in a solid state in the recording layer at temperatures below 50° C., but becomes a plasticizer for the recording layer where thermally heated and/or a liquid solvent for at least one of the redox-reactants, e.g. the reducing agent for the substantially light-insensitive silver salt of an organic carboxylic acid, at a temperature above 60° C. Useful for the purpose are the polyethylene glycols having a mean molecular weight in the range of 1,500 to 20,000 described in U.S. Pat. No. 3,347,675. Other suitable heat solvents are compounds such as urea, methyl sulfonamide and ethylene carbonate as described in U.S. Pat. No. 3,667,959; compounds such as tetrahydro-thiophene-1,1-dioxide, methyl anisate and 1,10-decanediol as described in Research Disclosure 15027 published in December 1976; and those described in U.S. Pat. No. 3,438,776, U.S. Pat. No. 4,740,446, U.S. Pat. No. 5,368,979, EP-A 0 119 615, EP-A 122 512 and DE-A 3 339 810.

Toning Agents

In order to obtain a neutral black image tone in the higher densities and neutral grey in the lower densities, photothermographic materials according to the present invention may contain one or more toning agents. The toning agents should be in thermal working relationship with the substantially light-insensitive silver salt of an organic carboxylic acids and reducing agents during thermal processing. Any known toning agent from thermography or photothermography may be used.

Suitable toning agents are succinimide and the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type within the scope of following general formula are described in GB-P 1,439,478 and U.S. Pat. No. 3,951,660:

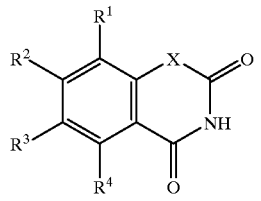

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring.

A toner compound, according to the above general formula, particularly suited for use in combination with polyhydroxy benzene reducing agents is benzo[e][1,3] oxazine-2,4-dione.

Stabilizers and Antifoggants

In order to obtain improved shelf-life and reduced fogging, stabilizers and antifoggants may be incorporated into the photothermographic materials of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

Surfactants

Non-ionic, cationic or anionic surfactants may be used, according to the present invention, to produce dispersions of particles of the substantially light-insensitive silver salt of an organic carboxylic acid in aqueous media and to disperse water-dispersible binders, such as polymer latexes, in aqueous media. A mixture of non-ionic and anionic surfactacts, of non-ionic and cationic surfactants, of cationic and anionic surfactants or of non-ionic, cationic and anionic surfactants may also be used, according to the present invention.

In one embodiment of the present invention the surfactant is an anionic surfactant. In a preferred embodiment of the present invention the anionic surfactant is a sulfonate e.g. alkyl, aryl, alkaryl or aralkyl sulfonate, with alkyl and alkaryl sulfonates being particularly preferred e.g.:

MERSOLAT™ H, a sodium salt of an alkyl sulfonate from BAYER

ULTRAVON™ W, a sodium salt of an aryl sulfonate from CIBA-GEIGY

In a further embodiment of the present invention the ionic surfactant is a non-ionic surfactant for example alkyl, aryl, alkaryl or aralkyl polyethoxy ethanols. Preferred non-ionic surfactants, according to the present invention, are alkoxy-polyethoxy ethanols and alkaryloxy-polyethoxy ethanols.

Additional Ingredients

In addition to the ingredients the photothermographic material may contain other additives such as free organic carboxylic acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG—GERMANY), ultraviolet light absorbing compounds, white light reflecting and/or ultraviolet radiation reflecting pigments, silica, and/or optical brightening agents.

Antihalation Dyes

In addition to the ingredients, the photothermographic recording material of the present invention may contain antihalation or acutance dyes which absorb light which has passed through the photosensitive layer, thereby preventing its reflection. Such dyes may be incorporated into the photo-addressable thermally developable element or in any other layer comprising the photothermographic recording material of the present invention. The anti-halation dye may also be bleached either thermally during the thermal development process, as disclosed in the U.S. Pat. Nos. 4,033,948, 4,088,497, 4,153,463, 4,196,002, 4,201,590, 4,271,263, 4,283,487, 4,308,379, 4,316,984, 4,336,323, 4,373,020, 4,548,896, 4,594,312, 4,977,070, 5,258,274, 5,314,795 and 5,312,721, or photo-bleached after removable after the thermal development process, as disclosed in the U.S. Pat. Nos. 3,984,248, 3,988,154, 3,988,156, 4,111,699 and 4,359,524. Furthermore the anti-halation layer may be contained in a layer which can be removed subsequent to the exposure process, as disclosed in U.S. Pat. No. 4,477,562 and EP-A 491 457. Suitable anti-halation dyes for use with infra-red light are described in the EP-A's 377 961 and 652 473, the EP-B's 101 646 and 102 781 and the U.S. Pat. Nos. 4,581,325 and 5,380,635.

Support

The support for the photothermographic recording material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. For example, a paper base substrate is present which may contain white reflecting pigments, optionally also applied in an interlayer between the recording material and the paper base substrate.

The support may be in sheet, ribbon or web form and subbed if needs be to improve the adherence to the thereon coated heat-sensitive recording layer.

Suitable subbing layers for improving the adherence of the thermosensitive element and the antistatic layer outermost backing layer of the present invention for polyethylene terephthalate supports are described e.g. in GB-P 1,234,755, U.S. Pat. Nos. 3,397,988; 3,649,336; 4,123,278 and U.S. Pat. No. 4,478,907 which relates to subbing layers applied from aqueous dispersion of sulfonated copolyesters, and further the subbing layers described in Research Disclosure published in Product Licensing Index, July 1967, p. 6.

Suitable pretreatments of hydrophobic resin supports are, for example, treatment with a corona discharge and/or attack by solvent(s), thereby providing a micro-roughening.

The support may be made of an opacified resin composition, e.g. polyethylene terephthalate opacified by means of pigments and/or micro-voids, and/or may be coated with an opaque pigment-binder layer, and may be called synthetic paper, or paperlike film. Information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

Protective Layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

This protective layer may have the same composition as an anti-sticking coating or slipping layer which is applied in thermal dye transfer materials at the rear side of the dye donor material or protective layers used in materials for direct thermal recording.

The protective layer preferably comprises a binder, which may be solvent soluble (hydrophobic), solvent dispersible, water soluble (hydrophilic) or water dispersible. Among the hydrophobic binders polycarbonates as described in EP-A 614 769 are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

A protective layer according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder. The surface active agents may be any agents known in the art such as carboxylates, sulfonates, aliphatic amine salts, aliphatic quaternary ammonium salts, polyoxyethylene alkyl ethers, polyethylene glycol organic carboxylic acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol and organic carboxylic acids. Suitable slipping layer compositions are described in e.g. EP 138483, EP 227090, U.S. Pat. Nos. 4,567,113, 4,572,860 and 4,717,711 and in EP-A 311841.

A suitable slipping layer being a layer comprising as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Other suitable protective layer compositions that may be applied as slipping (anti-stick) coating are described e.g. in published European patent applications (EP-A) 0 501 072 and 0 492 411.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Antistatic Layer

In a preferred embodiment the recording material of the present invention an antistatic layer is applied to the outermost layer on the side of the support not coated with the photo-addressable thermally developable element. Suitable antistatic layers therefor are described in EP-A's 444 326, 534 006 and 644 456, U.S. Pat. Nos. 5,364,752 and 5,472,832 and DOS 4125758.

Coating Techniques

The coating of any layer of the photothermographic materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Recording Process

Photothermographic materials, according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Applications

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and the paper base substrate. Should a transparent base be used, the base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

The following ingredients in addition to those mentioned above were used in the photothermographic recording materials of the examples and comparative examples illustrating this invention:

- reducing agents from the detailed description of U.S. Pat. No. 3,152,904:
  - REDU C01: phenidone (1-phenyl-3-pyrazolidinone)
  - REDU C02: methylphenidone (4-methyl-1-phenyl-3-pyrazolidinone)
  - REDU C03: dimethylphenidone (4,4-dimethyl-1-phenyl-3-pyrazolidinone)
  - REDU C04: hydroxymethyl-methylphenidone (4-hydroxymethyl-4-dimethyl-1-phenyl-3-pyrazolidinone)
  - REDU C05: p-aminophenol
  - REDU C06: hydroquinone
  - REDU C07: catechol
  - REDU C08: phenylene diamine
- additional reducing agents to REDU C06, C07 and C08 in the detailed description of U.S. Pat. No. 4,144,072:
  - REDU C09: bis(3-t-butyl-2-hydroxy-5-methylphenyl) methane
  - REDU C10: α-naphthol
  - REDU C11: resorcinol
  - REDU C12: phlorglucinol
  - REDU C13: ascorbic acid
  - REDU C14: 1,2-diphenylsulfino-hydrazine
  - REDU C15: p-phenylsulfonamidophenol
- reducing agents from the detailed description of U.S. Pat. No. 4,123,274:
  - REDU C01, C02, C04, C05 C06, C08 and C13;
- additional reducing agent to REDU C01, C02, C03, C04, C06 and C13, in the detailed description of U.S. Pat. No. 4,529,689:

REDU C16: potassium hydroquinone monosulfonate reducing agents from the detailed description of U.S. Pat. No. 4,504,575:

REDU C06 and C16;

other reducing agents outside the scope of the present invention:

REDU C17: 3,4,5,2',3',4'-hexahydroxybenzophenone

REDU C18: tannic acid

REDU C19: ammonium 3,4-dihydroxybenzenesulfonate

REDU C20: sodium 5,6-dihydroxy-benzene-1,3-disulfonate

REDU C21: 6,7-dihydroxy-naphthalene-2-sulfonic acid

REDU C22: 4-amino-1-naphthol hydrochloride

REDU C23: 2-amino-3-hydroxy-6-sulfo-naphthalene

REDU C24: 4-(4'-carboxyphenylsulfonamido)phenol

Binders used in the comparative and invention examples:

GELATIN 01: type K7598 from AGFA GELATINFABRIK vorm. KOEPFF & SOEHNE (a low viscosity gelatin)

BINDER 01: copolymer consisting of 45% by weight of methylmethacrylate, 45% by weight of butadiene and 10% by weight of itaconic acid.

The following examples and comparative examples illustrate the present invention. The percentages and ratios used in the examples are by weight unless otherwise indicated.

COMPARATIVE EXAMPLES 1 TO 15 AND INVENTION EXAMPLE 1

Application of state of the art from solvent-coated photoaddressable thermally developable elements as represented by U.S. Pat. No. 3,152,904 and U.S. Pat. No. 4,144,072 to such elements coated from aqueous media:

In situ Preparation of a Silver Behenate/Silver Halide-emulsion

Silver behenate was prepared by dissolving 602.7 g (1.77 moles) of behenic acid in 6.027 L of 2-propanol at 65° C., converting the behenic acid to sodium behenate by adding 7.078 L of 0.25M aqueous sodium hydroxide to the stirred behenic acid solution and finally adding 4.424L of 0.4M aqueous silver nitrate the silver behenate precipitating out. This was filtered off and then washed with a mixture of 10% by volume of 2-propanol and 90% by volume of deionized water to remove residual sodium nitrate.

After drying at 45° C. for 12 h, the silver behenate was dispersed in deionized water with the anionic dispersion agents Ultravon™ W and Mersolat™ H producing, after rapid mixing to produce a predispersion and homogenization with a microfluidizer, a finely divided and stable dispersion containing 20% by weight of silver behenate, 2.1% by weight of Ultravon™ W and 0.203% by weight of Mersolat™ H. The pH of the resulting dispersion was adjusted to about 6.5.

The following ingredients were then added with stirring to the silver behenate dispersion; 2897 g ot a 30% by weight aqueous dispersion of BINDER 01 at pH 4, 260.9 g of a 25% by weight aqueous solution of PC02, to accomplish 9.8 mol % conversion of the silver behenate, and 88 g of a 32% by weight aqueous solution of succinimide also at pH 4.

Coating and Drying of the Photothermographic Material

A roll of subbed 100 μm thick polyethylene terephthalate support was doctor blade-coated with the resulting dispersion to a wet thickness of 53 μm and then dried in a hot air drying cupboard.

After drying the coated roll was cut into sheets which were then individually doctor blade-coated with solutions of the different reducing agents given below in table 1 for the materials of ucomparative examples 1 to 15 and invention example 1 in deionized water or methanol with quantities of solution corresponding to quantities of reducing agent corresponding to the molar ratio of silver behenate to reducing agent given in table 1. The resulting photothermographic material was allowed to dry on the coating bed for several minutes at 40° C. and then was dried for 1 hour in a hot air oven at 50° C.

Image-wise Exposure and Thermal Processing

The photothermographic material was then exposed to ultra-violet light through a test original in contact with the material in an Agfa-Gevaert™ DL 2000 exposure apparatus. Thermal development was carried out in pressure contact with a metal block whose temperature could be varied between 95 and 120° C. The thermal development conditions were adjusted to give the best image and the temperatures and heating times used are given in table 1. The quality of the image obtained was assessed qualitatively and awarded a numerical score between 0 and 5 where these values correspond to:

0=no image i.e. $D_{max}/D_{min} \leqq 1.2$

1=a very poor image i.e. $D_{max}/D_{min}$ between 1.3 and 2.0

2=a poor image i.e. $D_{max}/D_{min}$ between 2.1 and 3.9

3=a moderate image quality i.e. $D_{max}/D_{min}$ between 4.0 and 10.0

4=a good image i.e. $D_{max}/D_{min}$ between 10.1 and 17.0

5=a very good image with high contrast and good sharpness i.e. $D_{max}/D_{min} \geqq 17.1$ The numerical scores awarded to the materials of comparative examples 1 to 15 and invention example 1 are given in table 1. The maximum and minimum optical density values, $D_{max}$ and $D_{min}$, were determined using a MacBeth™ TR924 densitometer with a visible filter.

TABLE 1

| | Reducing agent | | Thermal development conditions | | Image quality/$D_{max}$ processing | |
|---|---|---|---|---|---|---|
| | code | moles/mol silver behenate | temperature [° C.] | time [s] | fresh | after 45 h at 35° C. |
| Comparative example number | | | | | | |
| 1 | REDU C01 | 0.55 | 105 | 2 | 2 | — |
| 2 | REDU C02 | 0.54 | 100 | 2 | 2 | — |

TABLE 1-continued

| | Reducing agent | | Thermal development conditions | | Image quality/$D_{max}$ | |
|---|---|---|---|---|---|---|
| | code | moles/ mol silver behenate | temperature [° C.] | time [s] | fresh | processing after 45 h at 35° C. |
| 3 | REDU C03 | 0.48 | 100 | 2 | 2 | — |
| 4 | REDU C04 | 0.52 | 105 | 2 | 2 | — |
| 5 | REDU C05 | 0.69 | 105 | 5 | 1 | — |
| 6 | REDU C06 | 0.55 | 105 | 5 | 5/2.23 | 4/1.35 |
| 7 | REDU C07 | 0.55 | 105 | 5 | 5/2.19 | 0/0.32 |
| 8 | REDU C08 | 0.55 | 120 | 10 | 2 | — |
| 9 | REDU C09 | 0.8 | 120 | 30 | 2 | — |
| 10 | REDU C10 | 1.11 | 100 | 10 | 4 | 2 |
| 11 | REDU C11 | 0.54 | 120 | 30 | 0 | — |
| 12 | REDU C12 | 0.36 | 120 | 30 | 0 | — |
| 13 | REDU C13 | 0.28 | 95 | 15 | 2 | — |
| 14 | REDU C14 | 0.6 | 120 | 15 | 0 | — |
| 15 | REDU C15 | 1.1 | 120 | 30 | 1 | — |
| Invention example number | | | | | | |
| 1 | REDU 01 | 0.37 | 110 | 5 | 4 | — |

The results in table 1 show that of the 16 reducing agents given in U.S. Pat. Nos. 3,152,904 and 4,144,072 as being suitable for use in photothermographic materials, only four: hydroquinone (REDU C06), catechol (REDU C07), α-naphthol (REDU C10) and methyl gallate (REDU 01) were found to give at least good image quality for the photothermographic materials coated from aqueous media of the present invention. Of the photothermographic materials with these four reducing agents, three (with hydroquinone, catechol and α-naphthol) exhibited prohibitive loss in performance, as shown by strongly reduced image density $D_{max}$, after storage at 35° C. for 45 hours. It is therefore evident on the basis of the results in table 1 that one skilled in the art could not extrapolate the teaching for photothermographic materials on the basis of silver halide/silver salt of an organic carboxylic acid/reducing agent coated from solvent media to photothermographic materials on the basis of silver halide/silver salt of an organic carboxylic acid/reducing agent coated from aqueous media without undue experimentation.

INVENTION EXAMPLES 2 TO 4 AND COMPARATIVE EXAMPLE 16

Application of the state of the art from photo-addressable thermally developable elements coated from aqueous media as represented by U.S. Pat. Nos. 4,123,274, 4,529,689 and 4,504,575:

The materials of invention examples 2 to 4 and comparative example 16 were produced as described for comparative examples 1 to 15 and invention example 1 except that other reducing agents were used as given in tables 2 and 3 respectively.

Imagewise exposure and thermal development of these materials and evaluation of the resulting images were carried out also as described for comparative examples 1 to 15 and invention example 1, with the thermal development conditions used and the numerical scores for image quality being given in table 2 for the comparative examples together with the corresponding results for the materials of comparative examples 1 to 6, 8 and 13 and in table 3 for the invention examples.

TABLE 2

| | Reducing agent | | Thermal development conditions | | Image quality/$D_{max}$ | |
|---|---|---|---|---|---|---|
| Comparative example number | code | moles/ mol silver behenate | temperature [° C.] | time [s] | fresh | processing after 45 h at 35° C. |
| 1 | REDU C01 | 0.55 | 105 | 2 | 2 | — |
| 2 | REDU C02 | 0.54 | 100 | 2 | 2 | — |
| 3 | REDU C03 | 0.48 | 100 | 2 | 2 | — |
| 4 | REDU C04 | 0.52 | 105 | 2 | 2 | — |
| 5 | REDU C05 | 0.69 | 105 | 5 | 1 | — |
| 6 | REDU C06 | 0.55 | 105 | 5 | 5/2.23 | 4/1.35 |
| 8 | REDU C08 | 0.55 | 120 | 10 | 2 | — |
| 13 | REDU C13 | 0.28 | 95 | 15 | 2 | — |
| 16 | REDU C16 | 0.55 | 116 | 30 | 2 | — |

TABLE 3

| Invention example number | Reducing agent code | Reducing agent moles/mol silver behenate | Thermal development conditions temperature [° C.] | Thermal development conditions time [s] | Image quality/$D_{max}$ fresh | Image quality/$D_{max}$ processing after 45 h at 35° C. |
|---|---|---|---|---|---|---|
| 2 | REDU 02 | 0.54 | 105 | 5 | 5 | — |
| 3 | REDU 03 | 0.55 | 105 | 5 | 5/2.08 | 4/2.10 |
| 4 | REDU 04 | 0.54 | 95 | 10 | 4 | — |

The results of tables 2 and 3 show that of the 12 reducing agents given in U.S. Pat. Nos. 4,123,274, 4,529,689 and 4,504,575 as being suitable for photothermographic materials coated from aqueous media, only four: hydroquinone (REDU C06), methylhydroquinone (REDU 02), t-butylhydroquinone (REDU 03) and methoxyhydroquinone (REDU 04) were found to give at least good image quality for the photothermographic materials coated from aqueous media of the present invention. Of the photothermographic materials with these four reducing agents, one (with hydroquinone) exhibited prohibitive loss in performance, as shown by strongly reduced image density $D_{max}$, after storage at 35° C. for 45 hours, unlike that with t-butylhydroquinone. It is therefore evident on the basis of the results in tables 2 and 3 that one skilled in the art could not extrapolate the teaching for photothermographic materials coated from aqueous media on reducing agents on the basis of silver halide/silver sulfonates/reducing agent-materials (as described in U.S. Pat. No. 4,529,689), silver halide/silver sulfinates/reducing agent-materials (as described in U.S. Pat. No. 4,504,575) or silver halide/silver salts of 3-amino-1,2,4-mercaptotriazoles/reducing agent-materials (as described in U.S. Pat. No. 4,123,274) to photothermographic materials on the basis of silver halide/silver salt of an organic carboxylic acid/reducing agent-materials coated from aqueous media, without undue experimentation.

INVENTION EXAMPLES 5 TO 22 AND COMPARATIVE EXAMPLES 17 to 24

The materials of invention examples 5 to 22 and comparative examples 17 to 24 were produced as described for comparative examples 1 to 15 and invention example 1 except that other reducing agents were used as given in tables 4 and 5 for the comparative examples and invention examples respectively.

Imagewise exposure and thermal development of these materials and evaluation of the resulting images were carried out also as described for comparative examples 1 to 15 and invention example 1, with the thermal development conditions used and the numerical scores for image quality being given in tables 4 and 5 for the comparative examples and invention examples respectively.

TABLE 4

| Comparative example number | Reducing agent code | Reducing agent moles/mol silver behenate | Thermal development conditions temperature [° C.] | Thermal development conditions time [s] | Image quality/$D_{max}$ fresh | Image quality/$D_{max}$ processing after 45 h at 35° C. |
|---|---|---|---|---|---|---|
| 6 | REDU C06 | 0.55 | 105 | 5 | 5/2.23 | 4/1.35 |
| 7 | REDU C07 | 0.55 | 105 | 5 | 5/2.19 | 0/0.32 |
| 16 | REDU C16 | 0.55 | 116 | 30 | 2 | — |
| 17 | REDU C17 | 0.2 | 120 | 5 | 1 | — |
| 18 | REDU C18 | 0.04 | 120 | 20 | 0 | — |
| 19 | REDU C19 | 0.55 | 115 | 20 | 1 | — |
| 20 | REDU C20 | 0.54 | 115 | 30 | 0 | — |
| 21 | REDU C21 | 0.23 | 120 | 30 | 0 | — |
| 22 | REDU C22 | 0.15 | 110 | 15 | 1 | — |
| 23 | REDU C23 | 0.23 | 120 | 15 | 0 | — |
| 24 | REDU C24 | 0.31 | 115 | 30 | 0 | — |

It is evident from the results in table 4 that materials with hydroquinone (REDU C06) and catechol (REDU C07) give very good image quality upon printing in the fresh state, but after storage at 35° C. for 45 hours, simulating long term storage in sub-tropical conditionals, there is a strong deterioration in printing performance.

Materials with hydroquinones and catechols substituted with one or more sulfo-groups exhibit poor imaging performance as shown by the results with REDU's C16, C19, C20, C21 and C23. Materials with hydroquinones and catechols substituted with aryl- or oxo-aryl substituents in which the aryl groups are themselves substituted with hydroxy-groups also exhibit poor imaging performance as shown by the results with REDU C14 and REDU C15 as do materials with reducing agents with a hydroxy- and an amino-group, but without a non-sulfo-electron withdrawing group, as shown by the results with REDU C05 and REDU C22.

TABLE 5

| Invention example number | Reducing agent code | Reducing agent moles/mol silver behenate | Thermal development conditions temperature [° C.] | Thermal development conditions time [s] | Image quality/$D_{max}$ fresh | Image quality/$D_{max}$ processing after 45 h at 35° C. |
|---|---|---|---|---|---|---|
| 1 | REDU 01 | 0.37 | 110 | 5 | 4 | — |
| 2 | REDU 02 | 0.54 | 105 | 5 | 5 | — |
| 3 | REDU 03 | 0.55 | 105 | 5 | 5/2.08 | 4/2.10 |
| 4 | REDU 04 | 0.54 | 95 | 10 | 4 | — |
| 5 | REDU 05 | 0.55 | 105 | 5 | 5/2.01 | 5/1.99 |
| 6 | REDU 06 | 0.48 | 105 | 5 | 5 | — |
| 7 | REDU 07 | 0.55 | 115 | 20 | 5 | — |
| 8 | REDU 08 | 0.55 | 110 | 10 | 5 | — |
| 9 | REDU 09 | 0.53 | 120 | 20 | 3 | — |
| 10 | REDU 10 | 0.54 | 110 | 10 | 5 | — |
| 11 | REDU 11 | 0.55 | 105 | 5 | 4 | — |
| 12 | REDU 12 | 0.55 | 105 | 5 | 4 | — |
| 13 | REDU 13 | 0.55 | 120 | 10 | 4/3.10 | 3/2.44 |
| 14 | REDU 14 | 0.55 | 120 | 10 | 5 | — |
| 15 | REDU 15 | 0.55 | 105 | 5 | 5 | — |
| 16 | REDU 16 | 0.36 | 110 | 5 | 4 | — |
| 17 | REDU 17 | 0.97 | 120 | 5 | 3 | — |
| 18 | REDU 18 | 0.28 | 105 | 15 | 5 | — |
| 19 | REDU 19 | 0.54 | 110 | 10 | 4 | — |
| 20 | REDU 20 | 0.54 | 105 | 15 | 5 | — |
| 21 | REDU 21 | 0.18 | 110 | 20 | 3 | — |
| 22 | REDU 22 | 0.54 | 110 | 20 | 4 | — |

The results in table 5 for reducing agents according to the present invention show that materials with appropriately substituted catechols and hydroquinones as reducing agent exhibit satisfactory to very good imaging performance when imagewise exposed and thermally processed. Furthermore, this superior imaging performance was maintained after storage at 35° C. for 45 hours, simulating storage under sub-tropical conditions.

INVENTION EXAMPLE 23

A sodium behenate solution was prepared by first dissolving 34 kg of behenic acid in 340L of isopropanol at 65° C. and then adding with stirring a 0.25N solution of sodium hydroxide until a solution pH of 8.7 was obtained. This required about 400L of 0.25N NaOH. The concentration of the resulting solution was then adjusted to a sodium behenate concentration of 8.9% by weight and a concentration of isopropanol in the solvent mixture of 16.7% by volume, by a combination of evaporation and dilution.

The silver behenate synthesis was carried out at a constant UAg of 400 mV as follows: to a stirred solution of 30 g of GELATIN 01 in 750 mL of distilled water at 72° C. in a double walled reactor, several drops of a 2.94M aqueous solution of silver nitrate were added to adjust the UAg at the start of the reaction to 400 mV and then 374 mL of the sodium behenate solution, whose preparation is described above, at a temperature of 78° C. was metered into the reactor at a rate of 46.6 mL/min and simultaneously a 2.94M aqueous solution of silver nitrate was metered into the reactor, its addition rate being controlled by the quantity of the silver nitrate solution necessary to maintain a UAg of 400±5 mV in the dispersing medium in the reactor. Both the sodium behenate and silver nitrate solutions were added to the dispersing medium via small diameter tubes positioned just under the surface of the dispersing medium.

By the end of the addition step 0.092 moles of sodium behenate and 0.101 moles of silver nitrate had been added. The mixture was then stirred for a further 30 minutes.

Transmission electron micrographs of the resulting suspension showed that the suspension consisted, for the most part, of very fine particles, which are clearly not needle-shaped, having no obvious preferred growth direction, and have diameters of 40 to 60 nm.

To this suspension at 72° C. was added dropwise with stirring an aqueous solution 2.94 molar in halide, made up of 95% by weight of potassium bromide and 5% by weight of potassium iodide, until a UAg of 225 mV was attained. This process required 7.5 mL of the halide solution, whereby silver bromide and silver iodide were formed and the free silver ion concentration was strongly reduced. In this process some of the silver behenate may also have been converted into silver halide. After halide solution addition, the reaction mixture was stirred for a further 30 minutes at 72° C. The dispersion obtained after this step contained 0.079 moles of silver behenate and 0.022 moles of silver halide.

0.014 g of succinimide was added to 10 g of the dispersion from and the resulting dispersions was coated at a temperature of 40° C., using a doctor blade coater with a slit-width of 120 $\mu$m, onto a subbed 100 $\mu$m thick polyester sheet. After drying the layer was coated with a 3.9% aqueous solution of 3,4-dihydroxyphenylpropionic acid using a doctor blade coater with a slit-width of 50 $\mu$m. After drying the resulting photothermographic material was image-wise exposed, thermally developed and the resulting image evaluated as described for comparative examples 1 to 15 and invention example 1 with settings of 30s and 85° C. being used. A good quality image with high contrast and good sharpness which was awarded a numerical score of 4.

INVENTION EXAMPLE 24

In situ Preparation of a Silver Behenate/Silver Halide-emulsion

Silver behenate was prepared by dissolving 34 g (0.1 moles) of behenic acid in 340 mL of 2-propanol at 65° C., converting the behenic acid to sodium behenate by adding 400 mL of 0.25M aqueous sodium hydroxide to the stirred behenic acid solution and finally adding 250 mL of 0.4M aqueous silver nitrate the silver behenate precipitating out. This was filtered off and then washed with a mixture of 10% by volume of 2-propanol and 90% by volume of deionized water to remove residual sodium nitrate.

After drying at 45° C. for 12 h, the silver behenate was dispersed in deionized water with the anionic dispersion agents Ultravon™ W and Mersolat™ H an aqueous solution producing after rapid mixing to produce a predispersion and homogenization with a microfluidizer a finely divided and stable dispersion containing 20% by weight of silver behenate, 2.1% by weight of Ultravon™ W and 0.203% by weight of Mersolat™ H. The pH of the resulting dispersion was adjusted to about 6.5.

The following ingredients were then added with stirring to 1.5 g of the silver behenate dispersion: 1 g of a 30% by weight concentration of BINDER 01, 0.013 g of succinimide, 0.1 g of a 11% by weight solution of saponin in a mixture of deionized water and methanol and 2.4 g of a 1.28% by weight aqueous solution of 3-(triphenylphosphonium)propionic acid bromide perbromide (PC01), corresponding to a concentration of 8 mol % of PC01 with respect to silver behenate, to accomplish in situ conversion of part of the silver behenate to silver bromide.

Transmission Electron Micrograph of the Resulting Silver Behenate/Silver Bromide Dispersion The transmission electron micrograph of the resulting dispersion produced at a magnification of 50,000× (1 cm=200 nm) is shown in FIG. 1. The large rod-shaped particles are silver behenate. The very small black particles, ≦40 nm in diameter, uniformly distributed over these silver behenate particles and also uniformly distributed between these particles are silver bromide particles.

Coating and Drying of the Photothermographic Material

A subbed polyethylene terephthalate support having a thickness of 100 μm was doctor blade-coated with the silver behenate/silver bromide dispersion at a blade setting of 60 μm. After drying for several minutes at 40° C. on the coating bed, the emulsion layer was then doctor blade-coated with a 2.44% by weight aqueous solution of 3-(3,4-dihydroxyphenyl)propionic acid at a blade setting of 30 μm. The resulting thermographic material was first allowed to dry on the coating bed for several minutes at 40° C. and then was dried for 1 hour in a hot air drying cupboard at 50° C.

After drying the resulting photothermographic material was image-wise exposed, thermally developed and the resulting image evaluated as described for comparative examples 1 to 15 and invention example 1 with settings of 30s and 85° C. being used. A good quality image with high contrast and good sharpness which was awarded a numerical score of 4.

Having described in detail preferred embodiments of the current invention, it will now be apparent to those skilled in the art that numerous modifications can be made therein without departing from the scope of the invention as defined in the following claims.

We claim:

1. A process for producing a photothermographic recording material comprising the step of coating one or more aqueous dispersions onto a support, said one or more aqueous dispersions which when taken together include:

particles of a substantially light-insensitive silver salt of an organic carboxylic acid;

particles of a photosensitive silver halide in catalytic association with said substantially light-insensitive silver salt of an organic carboxylic acid;

a binder comprising monomer units selected from the group consisting of a diene-monomer, a methacrylate, styrene and an acrylate; and an organic reducing agent for said substantially light-insensitive silver salt of an organic carboxylic acid in thermal working relationship therewith, wherein said reducing agent is selected from the group consisting of (i) an aromatic ring compound selected from the group consisting of a substituted catechol and a substituted hydroquinone, said aromatic ring compound having one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl;

(ii) a 5-hydroxy-anthranilic acid;

(iii) a 2,3-dihydroxy pyridine;

(iv) a 2,3-dihydroxy pyridine that is further substituted with one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl;

(v) a 1,5-dihydroxy naphthalene or a 2,3-dihydroxy naphthalene;

(vi) a 1,5-dihydroxy naphthalene or a 2,3-dihydroxy naphthalene that is further substituted with one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl;

(vii) a 3,3,3',3'-tetramethyl-1,1'-spirobisindane-5,5',6,6'-tetrol;

(viii) a 2-amino-5-dimethylaminosulfonyl-phenol; and combinations thereof.

2. The process according to claim 1, wherein said reducing agent is a substituted catechol selected from the group consisting of 3-(3',4'-dihydroxyphenyl) propionic acid, (3',4'-dihydroxyphenyl) acetic acid, 3,4-dihydroxybenzoic acid, methyl 3,4-dihydroxy-5-methoxybenzoate, methyl 3,4-dihydroxy-5-toluenesulfonylbenzoate, 3',4'-dihydroxybutyrophenone, 3,5-di-t-butyl-catechol, 4-phenylcatechol, and combinations thereof.

3. The process according to claim 1, wherein said reducing agent is a substituted hydroquinone selected from the group consisting of methylhydroquinone, t-butylhydroquinone, methoxyhydroquinone, 2,5 dihydroxybenzoic acid, ethyl 2,5-dihydroxybenzoate, and combinations thereof.

4. The process according to claim 1, wherein said reducing agent is selected from the group consisting of 3-(3',4'-dihydroxyphenyl) propionic acid, 3',4'-dihydroxybutyrophenone, methyl gallate, ethyl gallate, 1,5-dihydroxynaphthalene, and combinations thereof.

5. The process according to claim 1, wherein said binder is a polymer latex.

6. The process according to claim 1, wherein said photoaddressable thermally developable element further comprises a dye with maximum absorbance in the wavelength range of 600 to 1100 nm.

7. The process according to claim 1, wherein said particles of a substantially light-insensitive silver salt of an organic carboxylic acid is produced by simultaneous metered addition of an aqueous solution or suspension of an organic carboxylic acid, or its salt, and an aqueous solution of a silver salt to an aqueous liquid; wherein the amount of said aqueous solution of said silver salt is regulated by the concentration of silver ions or the concentration of anions of said silver salt in said aqueous liquid.

8. The process according to claim 7, wherein said process further includes the step of producing particles of said photosensitive silver halide from excess silver ions associated with particles of said substantially light-insensitive silver salt of an organic carboxylic acid.

9. The process according to claim 1, wherein said particles of a substantially light-insensitive silver salt of an organic carboxylic acid have a diameter of 40 to 60 nm; and wherein said particles of a photosensitive silver halide have a diameter of less than or equal to 40 nm.

10. The process according to claim 1, wherein said reducing agent is a dihydroxy-substituted naphthalene selected from the group consisting of 2,3-dihydroxynaphthalene, 1,5-dihydroxynaphthalene, and combinations thereof.

11. The process according to claim 1, wherein said reducing agent is a substituted catechol selected from the group consisting of ethyl gallate, 1-methyl-3-oxy-pentyl gallate, and combinations thereof.

12. The process according to claim 1, wherein said reducing agent is selected from the group consisting of 3-(3',4'-dihydroxyphenyl) propionic acid, (3',4'-dihydroxyphenyl) acetic acid, 3,4-dihydroxybenzoic acid, methyl 3,4-dihydroxy-5-methoxybenzoate, methyl 3,4-dihydroxy-5-toluenesulfonylbenzoate, 3',4'-dihydroxybutyrophenone, 3,5-di-t-butyl-catechol, 4-phenylcatechol, methylhydroquinone, t-butylhydroquinone, methoxyhydroquinone, 2,5 dihydroxybenzoic acid, ethyl 2,5-dihydroxybenzoate, 2,3-dihydroxynaphthalene, 1,5-dihydroxynaphthalene, ethyl gallate, 1-methyl-3-oxy-pentyl gallate, 2,3-dihydroxypyridine, 3,3,3',3'-tetramethyl-1,1'-spirobisindane-5,5',6,6'-tetrol, 2 amino-5-dimethylaminosulfonyl-phenol, and combinations thereof.

13. The process according to claim 1, wherein said substantially light-insensitive silver salt of said organic carboxylic acid is a silver salt of an aliphatic carboxylic acid having an aliphatic carbon chain of at least 12 carbon atoms.

14. The process according to claim 13, wherein said silver salt of said aliphatic carboxylic acid is silver behenate.

15. The method according to claim 12, wherein said substantially light-insensitive silver salt of said organic carboxylic acid is a silver salt of an aliphatic carboxylic acid having an aliphatic carbon chain of at least 12 carbon atoms.

16. The method according to claim 15, wherein said silver salt of said aliphatic carboxylic acid is silver behenate.

17. A photothermographic recording method comprising the steps of:

(a) image-wise exposing a photothermographic recording material to a source of actinic radiation to which said photothermographic recording material is sensitive, wherein said photothermographic recording material is produced by a process comprising the step of coating one or more aqueous dispersions onto a support, said one or more aqueous dispersions which when taken together include:

particles of a substantially light-insensitive silver salt of an organic carboxylic acid;

particles of a photosensitive silver halide in catalytic association with said substantially light-insensitive silver salt of an organic carboxylic acid;

a binder comprising monomer units selected from the group consisting of a diene-monomer, a methacrylate, styrene and an acrylate; and an organic reducing agent for said substantially light-insensitive silver salt of an organic carboxylic acid in thermal working relationship therewith, wherein said reducing agent is selected from the group consisting of (i) an aromatic ring compound selected from the group consisting of a substituted catechol and a substituted hydroquinone, said aromatic ring compound having one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl;

(ii) a 5-hydroxy-anthranilic acid;

(iii) a 2,3-dihydroxy pyridine;

(iv) a 2,3-dihydroxy pyridine that is further substituted with one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl;

(v) a 1,5-dihydroxy naphthalene or a 2,3-dihydroxy naphthalene;

(vi) a 1,5-dihydroxy naphthalene or a 2,3-dihydroxy naphthalene that is further substituted with one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl;

(vii) a 3,3,3',3'-tetramethyl-1,1'-spirobisindane-5,5',6,6'-tetrol;

(viii) a 2-amino-5-dimethylaminosulfonyl-phenol; and combinations thereof; and (b) thermally developing said image-wise exposed photothermographic recording material.

18. The method according to claim 17, wherein said particles of a substantially light-insensitive silver salt of an organic carboxylic acid have a diameter of 40 to 60 nm; and wherein said particles of a photosensitive silver halide have a diameter of less than or equal to 40 nm.

19. A photothermographic recording material, comprising:

particles of a substantially light-insensitive silver salt of an organic carboxylic acid, said substantially light-insensitive particles having a diameter of 40 to 60 mn;

particles of a photosensitive silver halide in catalytic association with said particles of a substantially light-insensitive silver salt of an organic carboxylic acid, said photosensitive silver halide particles having a diameter of less than or equal to 40 nm;

a binder comprising monomer units selected from the group consisting of a diene-monomer, a methacrylate, styrene and an acrylate; and an organic reducing agent for said substantially light-insensitive silver salt of an organic carboxylic acid in thermal working relationship therewith, wherein said reducing agent is selected from the group consisting of (i) an aromatic ring compound selected from the group consisting of a substituted catechol and a substituted hydroquinone, said aromatic ring compound having one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl;

(ii) a 5-hydroxy-anthranilic acid;

(iii) a 2,3'-dihydroxy pyridine;

(iv) a 2,3-dihydroxy pyridine that is further substituted with one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-ary;

(v) a 1,5-dihydroxy napithalene or a 2,3-dihidroxy naphthalene;

(vi) a 1,5-dihydroxy naphthalene or a 2,3-dihydroxy naphthalene that is further substituted with one or more substituents selected from the group consisting of alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl;

(vii) a 3,3,3',3'-tetramethyl-1,1'-spirobisindane-5,5',6,6'-tetrol;

(viii) a 2-amino-5-dimethylaminosulfonyl-phenol; and combinations thereof.

20. The photothermographic recording material according to claim 19, wherein said reducing agent is selected from the group consisting of 3-(3',4'-dihydroxyphenyl) propionic acid, (3',4'-dihydroxyphenyl) acetic acid, 3,4-dihydroxybenzoic acid, methyl 3,4-dihydroxy-5-methoxybenzoate, methyl 3,4-dihydroxy-5-toluenesulfonylbenzoate, 3',4'-dihydroxy-butyrophenone, 3,5-di-t-butyl-catechol, 4-phenylcatechol, methylhydroquinone, t-butylhydroquinone, methoxyhydroquinone, 2,5 dihydroxybenzoic acid, ethyl 2,5-dihydroxybenzoate, 2,3-dihydroxynaphthalene, 1,5-dihydroxymaphthalene, ethyl gallate, 1-methyl-3-oxy-pentyl gallate, 2,3-dihydroxypyridine, 3,3,3',3'-tetramethyl-1,1'-spirobisindane-5,5',6,6'-tetrol, 2 amino-5-dimethylaminosulfonyl-phenol, and combinations thereof.

21. The photothermographic recording material according to claim 19, wherein said substantially light-insensitive silver salt of said organic carboxylic acid is a silver salt of an aliphatic carboxylic acid having an aliphatic carbon chain of at least 12 carbon atoms.

22. The photothermographic recording material according to claim 21, wherein said silver salt of said aliphatic carboxylic acid is silver behenate.

* * * * *